US010815573B2

(12) United States Patent
Dictus

(10) Patent No.: US 10,815,573 B2
(45) Date of Patent: Oct. 27, 2020

(54) PASSIVATION MIXTURE AND SYSTEMS AND METHODS FOR SELECTIVELY PASSIVATING SUBSTRATE MATERIALS INCLUDING GERMANIUM OR TYPE III-IV MATERIALS USING THE PASSIVATION MIXTURE

(71) Applicant: Lam Research AG, Villach (AT)

(72) Inventor: Dries Dictus, Villach (AT)

(73) Assignee: LAM RESEARCH AG, Villach (AT)

( * ) Notice: Subject to any disclaimer, the term of this patent is extended or adjusted under 35 U.S.C. 154(b) by 469 days.

(21) Appl. No.: 15/608,416

(22) Filed: May 30, 2017

(65) Prior Publication Data

US 2018/0347053 A1 Dec. 6, 2018

(51) Int. Cl.

| | |
|---|---|
| ***C23C 22/48*** | (2006.01) |
| ***C23C 22/73*** | (2006.01) |
| ***C23C 22/60*** | (2006.01) |
| *C23C 22/00* | (2006.01) |

(52) U.S. Cl.

CPC ..... *C23C 22/73* (2013.01); *C23C 22/60* (2013.01)

(58) Field of Classification Search

None

See application file for complete search history.

(56) References Cited

U.S. PATENT DOCUMENTS

| | | | | |
|---|---|---|---|---|
| 3,615,895 | A * | 10/1971 | Von Freyhold | C23C 22/83 148/256 |
| 6,380,097 | B1 | 4/2002 | Dauplaise et al. | |
| 2009/0121192 | A1* | 5/2009 | Abys | C23C 22/02 252/392 |
| 2010/0154673 | A1* | 6/2010 | Defalco | C23C 18/00 106/1.23 |
| 2012/0264309 | A1 | 10/2012 | Barnett et al. | |
| 2015/0118834 | A1 | 4/2015 | Loh et al. | |
| 2016/0268122 | A1 | 9/2016 | Oniki et al. | |
| 2016/0322515 | A1 | 11/2016 | Li et al. | |

OTHER PUBLICATIONS

International Search Report and Written Opinion dated Sep. 27, 2018 corresponding to PCT/IB2018/053820, 9 pages.

* cited by examiner

*Primary Examiner* — Lois L Zheng

(57) ABSTRACT

A liquid passivation mixture for passivating an outer layer of a substrate comprises a first material selected from group consisting of sulfur or selenium and a base selected from a group consisting of quaternary ammonium compound, sodium hydroxide (NaOH), potassium hydroxide (KOH), and amine.

11 Claims, 3 Drawing Sheets

PASSIVATION MIXTURE AND SYSTEMS AND METHODS FOR SELECTIVELY PASSIVATING SUBSTRATE MATERIALS INCLUDING GERMANIUM OR TYPE III-IV MATERIALS USING THE PASSIVATION MIXTURE

FIELD

The present disclosure relates to passivating substrate materials including germanium or a type material, and more particularly to a passivation mixture and systems and methods for selectively passivating substrate materials including germanium or type materials using the passivation mixture.

BACKGROUND

This background description is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During processing of a substrate such as a semiconductor wafer, an outer layer of the substrate including germanium (Ge) or type III-IV materials may need to be passivated using sulfur or selenium. Chemistries currently used for sulfur passivation of Ge include diammonium sulfide ($(NH_4)_2S$), thiosulfates, sulfites, thiols, or thioethers.

Because $(NH_4)_2S$ is unstable, uncontrolled sulfur deposition and particle issues may occur. $(NH_4)_2S$, thiols and thioethers have a strong odor due to decomposition byproducts including hydrogen sulfide ($H_2S$). Therefore, special handling is required during wet processing. Gas scrubbers may also be required and concentrated solutions of $(NH_4)_2S$ are flammable.

Thiosulfate and sulfite precursors produce weak passivation or need an in-situ reaction to form a sulfur layer. The process for thiosulfate and sulfite precursors is difficult to control and may cause particle formation.

SUMMARY

A liquid passivation mixture for passivating an outer layer of a substrate comprises a first material selected from group consisting of sulfur or selenium and a base selected from a group consisting of quaternary ammonium compound, sodium hydroxide (NaOH), potassium hydroxide (KOH), and amine.

In other features, the liquid passivation mixture includes water to dilute the liquid passivation mixture from 10 to 1000 times. The quaternary ammonium includes tetra-alkyl ammonium hydroxide. The amine is selected from a group consisting of ethylenediamine, alkanolamine, diethylenetriamine, N-methylpyrrolidone, acetamide, tertiary amine, secondary amine and primary amine.

In other features, the liquid passivation mixture includes a concentration of sulfide ions is in a range between 0.0001 to 10 molar (M).

In other features, the liquid passivation mixture includes a concentration of sulfide ions is in a range between 1 and 10M. The liquid passivation mixture has a pH greater than 6.

A method for passivating a substrate providing a substrate comprising an outer layer including a material selected from a group consisting of germanium and a type III/IV material and passivating the outer layer by dispensing the liquid passivation mixture onto the substrate.

In other features, the liquid passivation mixture is dispensed onto the substrate using a spin chuck. The method includes removing an oxidation layer on the substrate while the substrate is rotating using a first solution and prior to dispensing the liquid passivation mixture. The first solution includes an aqueous acid solution.

In other features, the first solution includes aqueous hydrofluoric (HF) acid. The method includes removing sub-oxides after removing the oxidation layer and prior to dispensing the liquid passivation mixture by dispensing a second solution onto the substrate while the substrate is rotating.

In other features, the second solution includes aqueous hydrochloric acid.

The method includes rinsing the substrate before and after dispensing the liquid passivation mixture. The method includes drying the substrate. The method includes maintaining an oxygen-free environment in a processing chamber enclosing the spin chuck.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
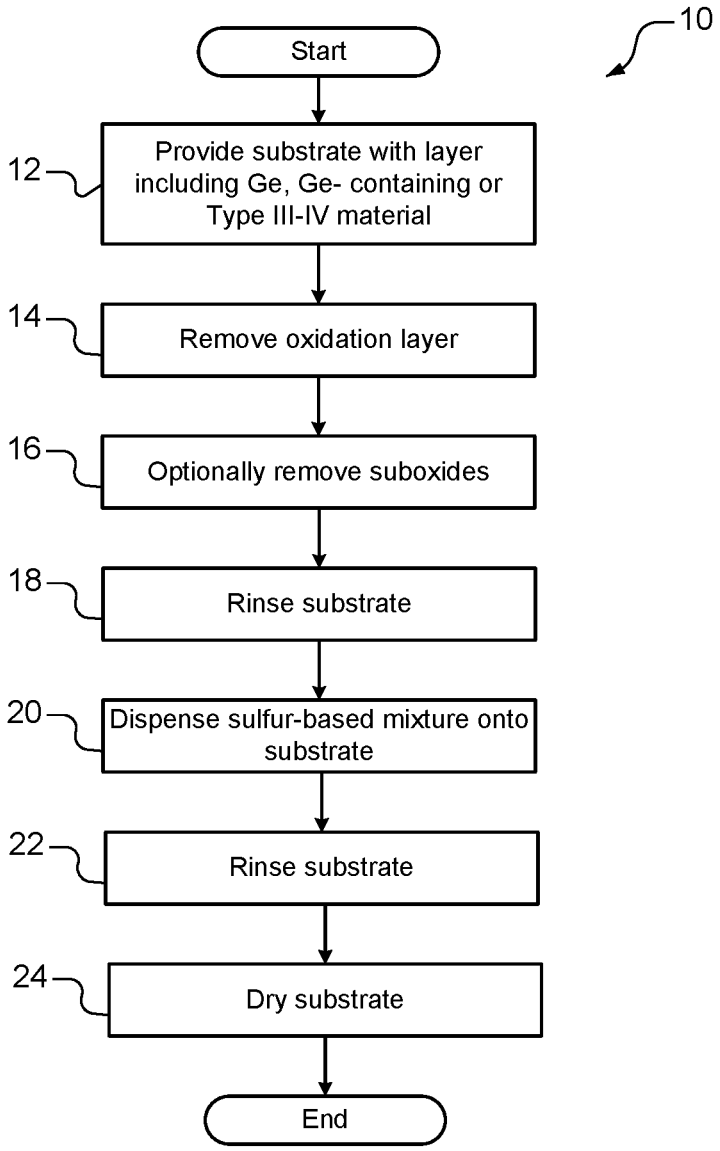
FIG. 1 is a flowchart illustrating an example of a method for applying a liquid passivation mixture to passivate a substrate material including germanium or a type III-IV material according to the present disclosure.

The present disclosure relates to a passivation mixture such as a sulfur-based mixture or a selenium-based mixture that can be used for passivating an outer layer of a substrate. Systems and methods for applying the passivation mixture to the outer layer of the substrate are also disclosed. The outer layer of the substrate is made of a material including germanium (Ge) or a type III-V material. As can be appreciated, the outer layer may include only Ge or the type III/IV material or the outer layer may include Ge or the type III/IV material and other substrate materials.

In some examples, the passivation mixture is prepared by dissolving sulfur or selenium in a base solution. The base is selected from a group consisting of quaternary ammonium compound, sodium hydroxide (NaOH), potassium hydroxide (KOH) or amines. In some examples, the amines are selected from a group consisting of ethylenediamine, alkanol amine (such as ethanolamine), diethylenetriamine, N-methylpyrrolidone, acetamide, tertiary amine, secondary amine and primary amine (such as methylamine, di-methylamine. In some examples, the quaternary ammonium compound includes tetra-alkyl ammonium hydroxide such as but not limited to tetramethylammonium hydroxide (TMAH or TMAOH) or tetraethylammonium hydroxide.

In some examples, the sulfur or selenium includes a powder that is dissolved in a base solution. In some examples, the passivation mixture includes sulfur or selenium (powder) and the base (salt) that are dissolved in water. In some examples, the sulfur is present as polysulfide ($S_8$). In some examples, the sulfur-based mixture is prepared by mixing sulfur in powder form with TMAH. In some examples, a concentrated mixture of (poly)sulfide ions and quaternary ammonium ions can be prepared by mixing sulfur in TMAH (or similar quaternary ammonium bases) or by dissolving the quaternary ammonium sulfide salt with water.

When exposing or immersing the outer layer of the substrate in the liquid passivation mixture or in aqueous dilutions of the liquid passivation mixture, one or more monolayers of sulfur or selenium are deposited on the substrate materials. The monolayers inhibit the oxidation of materials including germanium or a type III-V material for a predetermined period and can electrically passivate these materials.

The chemistries that are proposed herein for the passivation mixture produce approximately the same quality of passivation as other liquid chemistries that are used such as diammonium sulfide $(NH_4)_2S$-based sulfur passivation. However, the liquid passivation mixtures described herein have fewer problematic handling issues. In other words, there are no issues relating to odor, reaction rate or chemical stability. Further, most of the passivation mixtures described herein (other than some NaOH-based liquid passivation mixtures) are compatible with semiconductors. However, some amine-based solutions may interact with the atmosphere, which leads to degradation over time.

In some examples, the concentration of sulfide ions for at-use conditions is between 1 and 100 millimolar (mM). However, a range of 0.0001 to 10 molar (M) can be used. In some examples, the concentration of sulfide ions prior to dilution is between 1 and 10M range. In some examples, a concentrated passivation mixture is diluted 10-1000 times prior to usage. In some examples, the passivation mixture has an excess of base for stability reasons because polysulfide clusters are formed below a pH of 6-7. The polysulfide clusters may cause particle issues.

Referring now to FIG. 1, a method 10 for passivation a substrate including an outer layer made of a material including germanium (Ge) or a type III/IV material according to the present disclosure is shown. At 12, a substrate is provided and includes an outer layer made of a material including germanium (Ge) or a type III/IV material. At 14, an oxidation layer on the outer layer of the substrate is removed using any suitable process. At 16, sub-oxides are removed if needed using any suitable process. At 18, the substrate is rinsed. At 20, a liquid passivation mixture such as a sulfur-based mixture or a selenium-based mixture described herein is dispensed onto the substrate using any suitable process. At 22, the substrate is rinsed. At 24, the substrate is dried.

Figure 2A:
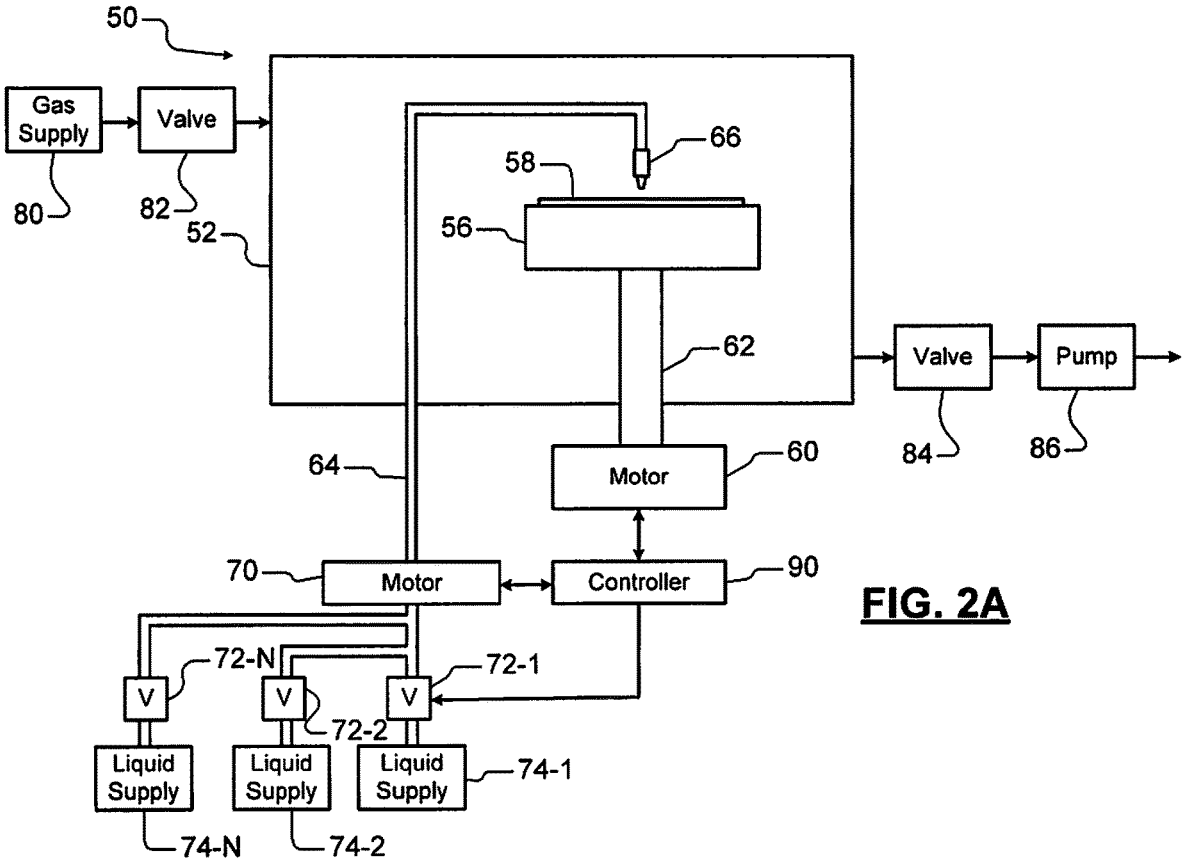
FIG. 2A is a functional block diagram of an example of a spin chuck configured to apply the liquid passivation mixture to passivate a substrate material including germanium or a type III-IV material according to the present disclosure.
Figure 2B:
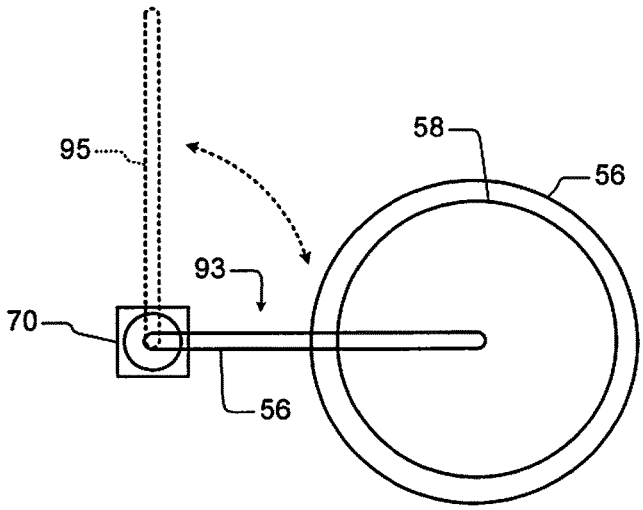
FIG. 2B is a plan view of the spin chuck of FIG. 2A.

In some examples, one or more steps of the method 10 may be performed using a spin chuck. Referring now to FIGS. 2A and 2B, an example of a spin chuck 50 that may be used to deliver the liquid passivation mixture such as the sulfur-based mixture or the selenium-based mixture onto the outer layer of the substrate is shown. In some examples, only the liquid passivation mixture is dispensed using the spin chuck. In other examples, some or all of the remaining steps described above and below are performed in the same spin chuck. While a specific example of a spin chuck is shown and described herein, other types of spin chucks can be used.

In FIG. 2A, the spin chuck 50 includes a processing chamber 52 and a rotatable chuck 56 supporting a substrate 58. In some examples, the processing chamber 52 provides a sealed environment such that gases in the processing chamber 52 can be selected to be something other than atmosphere as will be described further below.

A motor 60 rotates a shaft 62 connected to the rotatable chuck 56. A liquid delivery arm 64 and a nozzle 66 deliver one or more liquids onto a surface of the substrate 58 as the motor 60 rotates the shaft 62. One or more valves 72-1, 72-2, . . . 72-N (collectively valves 72) may be used to control delivery of one or more liquids from one or more liquid supplies 74-1, 74-2, . . . 74-N (collectively liquid supplies 74), where N is an integer greater than or equal to one. In some examples, the one or more liquids include deionized (DI) water, the liquid passivation mixture (such as the selenium-based mixture or the sulfur-based mixture described herein), cleaning liquids, dilute acid solutions, alcohols such as isopropyl alcohol (IPA) and/or other liquids.

A gas supply 80 and a valve 82 may be used to supply gas or a gas mixture to the processing chamber 52. In some examples, the gas or the gas mixture is an oxygen-free. In some examples, the gas for the gas mixture includes one or more inert gases. A valve 84 and a pump 86 may be used to remove gas from the processing chamber 52. A controller 90 may be used to control the motor 60, a motor 70, the pump 86 and the valves 72, 82 and 84 during processing. In FIG. 2B, a rotational position of the liquid delivery arm 64 may be adjusted from a dispensing position 93 to a storage position 95 shown in dotted lines using the motor 70.

Figure 3:
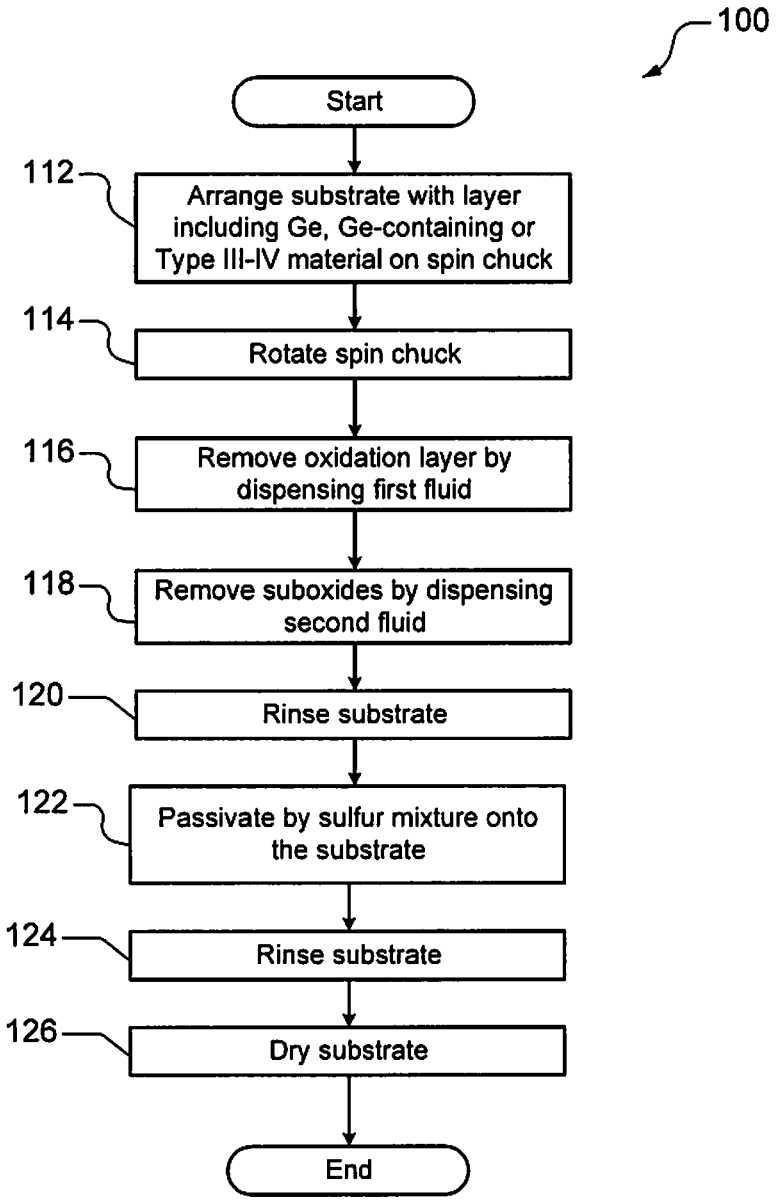
FIG. 3 is a flowchart illustrating another example of a method for applying the liquid passivation mixture to passivate a substrate material including germanium or a type III-IV material according to the present disclosure.

Referring now to FIG. 3, a more detailed example of a method 100 for passivating an outer layer of a substrate (that includes a material such as germanium or a type III/IV material) using a spin chuck is shown. At 112, a substrate is provided and includes an outer layer made of a material including germanium (Ge) or a type III/IV material. The substrate is arranged on a spin chuck. At 114, the substrate is rotated by the spin chuck.

At 116, an oxidation layer is removed by dispensing a first solution onto the substrate while the substrate is rotating. For example, the oxidation layer can be removed by dispensing an aqueous acid solution onto the substrate while the substrate is rotated by the spin chuck. For example, the aqueous acid solution may include hydrofluoric (HF) acid. For example, HF49% or up to 1000:1 dilution of HF49% can be used, although other solutions can be used.

At 118, sub-oxides are removed if needed by dispensing a second solution onto the substrate while the substrate is rotating. In some examples, an aqueous hydrochloric acid (HCl) solution can be used such as 36% HCl or up to 1:10 dilution of 36% HCl, although other solutions can be used.

At 120, the substrate is rinsed to avoid acid mixing with the passivation solution, which may cause particle formation. For example, the substrate can be rinsed using water or deionized (DI) water. At 122, a liquid passivation mixture such as the sulfur-based mixture or the selenium-based mixture described herein is dispensed onto the substrate while the substrate is rotated. At 124, the substrate is rinsed. For example, the substrate can be rinsed using DI water. At 126, the substrate is dried. In some examples, IPA and a gas such as molecular nitrogen ($N_2$) are used to dry the substrate, although other drying steps can be performed.

In some examples, the processing chamber 52 provides a molecular oxygen ($O_2$) free environment. In some examples, the solutions are $O_2$ free to provide optimal sulfur or selenium surface coverage (and not oxide coverage). In other examples, the processing chamber 52 operates using normal atmospheric gases.

In some examples, the rotatable chuck 56 is rotated at a speed greater than or equal to 50 rpm. In other examples, the rotatable chuck 56 is rotated at a speed greater than or equal to 300 rpm. In other examples, the rotatable chuck 56 is rotated at a speed of 1000 rpm. In some example, the liquid passivation mixture is dispensed as a free flowing liquid onto the substrate 58. In some examples, the liquid passivation mixture is dispensed at a temperature in a range from 10-40° C. (e.g. 25° C.). In some examples, the liquid solutions are dispensed at a flow rate in a range from 200-2000 ml/min, although other flow rates can be used.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A liquid passivation mixture for passivating an outer layer of a substrate, the liquid passivation mixture consisting of:

a base, wherein the base is an amine selected from a group consisting of ethylenediamine, alkanolamine, diethylenetriamine, N-methylpyrrolidone, acetamide, tertiary amine, secondary amine, and primary amine; and a first material dissolved into the base, wherein the first material is selected from a group consisting of sulfur and selenium.

2. The liquid passivation mixture of claim 1, further comprising water to dilute the liquid passivation mixture from 10 to 1000 times.

3. The liquid passivation mixture of claim 1, wherein a concentration of sulfide ions is in a range between 0.0001 to 10 molar (M).

4. The liquid passivation mixture of claim 1, wherein a concentration of sulfide ions is in a range between 1 and 10 M.

5. The liquid passivation mixture of claim 1, wherein the liquid passivation mixture has a pH greater than 6.

6. The liquid passivation mixture of claim 1, further comprising water to dilute the liquid passivation mixture from 10 to 1000 times.

7. The liquid passivation mixture of claim 1, wherein a concentration of sulfide ions is in a range between 0.0001 to 10 molar (M).

8. The liquid passivation mixture of claim 1, wherein a concentration of sulfide ions is in a range between 1 and 10 M.

9. The liquid passivation mixture of claim 1, wherein the liquid passivation mixture has a pH greater than 6.

10. A liquid passivation mixture for passivating an outer layer of a substrate, the liquid passivation mixture consisting of:

a base, wherein the base is a quaternary ammonium compound that includes tetra-alkyl ammonium hydroxide; and a first material dissolved into the base, wherein the first material is selected from a group consisting of sulfur and selenium.

11. A liquid passivation mixture for passivating an outer layer of a substrate, the liquid passivation mixture consisting of:

a base, wherein the base is an amine selected from a group consisting of tetra-alkyl ammonium hydroxide, ethylenediamine, alkanolamine, diethylenetriamine, N-methylpyrrolidone, acetamide, tertiary amine, secondary amine, and primary amine; and a first material dissolved into the base, wherein the first material is selected from a group consisting of sulfur and selenium.

* * * * *